US011751622B2

(12) United States Patent
Fu et al.

(10) Patent No.: US 11,751,622 B2
(45) Date of Patent: Sep. 12, 2023

(54) HELMET WITH SPLIT TYPE SKELETON STRUCTURE

(71) Applicant: Dongguan City EON Sporting Goods Co., Ltd., Dongguan (CN)

(72) Inventors: Jiabing Fu, Longyan (CN); Guoding Wang, Longyan (CN); Can Huang, Longyan (CN); Yong Zhang, Longyan (CN); Yiming Zhao, Longyan (CN); Fan Yang, Longyan (CN); Jiamu Zhan, Longyan (CN)

(73) Assignee: Dongguan City EON Sporting Goods Co., Ltd., Dongguan (CN)

( * ) Notice: Subject to any disclaimer, the term of this patent is extended or adjusted under 35 U.S.C. 154(b) by 14 days.

(21) Appl. No.: 17/647,174

(22) Filed: Jan. 6, 2022

(65) Prior Publication Data

US 2022/0125149 A1 Apr. 28, 2022

(30) Foreign Application Priority Data

Nov. 15, 2021 (CN) ..... 202111346920.5

(51) Int. Cl.

| | |
|---|---|
| ***A42B 3/20*** | (2006.01) |
| ***A42B 3/06*** | (2006.01) |
| ***A42B 3/32*** | (2006.01) |

(52) U.S. Cl.

CPC ..... *A42B 3/205* (2013.01); *A42B 3/063* (2013.01); *A42B 3/065* (2013.01); *A42B 3/326* (2013.01)

(58) Field of Classification Search

CPC ..... A42B 3/205; A42B 3/065; A42B 3/326; A42B 3/063; A42B 3/322

See application file for complete search history.

(56) References Cited

U.S. PATENT DOCUMENTS

| | | | | |
|---|---|---|---|---|
| 4,689,836 | A * | 9/1987 | Vitaloni ..... | A42B 3/222 2/9 |
| 2007/0226880 | A1 | 10/2007 | Shida | |
| 2012/0117718 | A1 | 5/2012 | Cho | |
| 2015/0335092 | A1 | 11/2015 | Erb et al. | |
| 2019/0000174 | A1 * | 1/2019 | Shaffer ..... | A42B 3/064 |

* cited by examiner

*Primary Examiner* — Khoa D Huynh
*Assistant Examiner* — Erick I Lopez
(74) *Attorney, Agent, or Firm* — Zhigang Ma

(57) ABSTRACT

The present disclosure discloses a helmet with a split type skeleton structure. The helmet includes a helmet body; the helmet body is composed of a head guard and a chin guard which are separated; the head guard and the chin guard are mounted through cooperation between a fastened spliced skeleton and a plug pin; the spliced skeleton is composed of two skeleton connection members arranged inside the head guard and a chin skeleton arranged inside the chin guard; and hollows of a surface of the chin skeleton are fixedly connected with a plurality of one-piece structured reinforcing ribs.

6 Claims, 5 Drawing Sheets

HELMET WITH SPLIT TYPE SKELETON STRUCTURE

TECHNICAL FIELD

The present disclosure relates to the technical field of helmet production, specifically to a helmet with a split type skeleton structure.

BACKGROUND

In sports such as cycling and skating, where the action is relatively intense, in order to prevent athletes' heads from being injured in accidents, athletes need to wear helmets on their heads for protection.

At present, an existing protective helmet on the market is generally made of an expandable polystyrene material. The manufactured helmet has the advantages of light weight, good heat dissipation, and the like. However, the polystyrene helmet has low anti-hitting strength. In case of a high hitting force, the helmet is extremely easy to break and fall apart. In order to increase the anti-hitting strength and structural strength of the helmet, a skeleton will be generally added during helmet machining. The skeleton structure of the current helmet is generally formed by one-piece injection molding, so that the skeleton has higher mold opening cost. Especially for the production of some skeletons with complex structures, the reject ratio of a product will be increased, and the production cost input of an enterprise is further increased.

Moreover, the current one-piece machined and formed skeletons are generally made of the same material. A head guard and a chin guard of the helmet cannot be disassembled during daily use, which reduces the flexible selectivity for a user in daily use of the helmet.

SUMMARY

The present disclosure aims to provide a helmet with a split type skeleton structure, so as to solve the problems that the skeleton structure of the current helmet mentioned in the background is generally formed by one-piece injection molding, so that the skeleton has higher mold opening cost and that the one-piece machined and formed skeletons are generally made of the same material, so that a head guard and a chin guard of the helmet cannot be disassembled during daily use.

In order to achieve the above purpose, the present disclosure provides the following technical solution: a helmet with a split type skeleton structure, including a helmet body. The helmet body is composed of a head guard and a chin guard which are separated, and the head guard and the chin guard are mounted through cooperation between a fastened spliced skeleton and a plug pin;

the spliced skeleton is composed of two skeleton connection members arranged inside the head guard and a chin skeleton arranged inside the chin guard; hollows of a surface of the chin skeleton is fixedly connected with a plurality of one-piece structured reinforcing ribs;

the helmet body is of a three-layer structure; an expanded polystyrene (EPS) liner is located at a middle layer; the EPS liner is wrapped outside the skeleton connection members and the chin skeleton; an inner side of the EPS liner is adhered with an EPS inner layer; and an outer side of the EPS liner is adhered with a polycarbonate (PC) surface layer.

As one preferable solution of the present disclosure, the bottom of one side of each skeleton connection member is fixedly connected with a one-piece structured T-shaped sliding clamping head; the top of one side of each skeleton connection member is fixedly connected with a one-piece structured sleeve member; and a first plug hole is formed in a surface of the sleeve member.

As one preferable solution of the present disclosure, a plug opening and a clamping opening are formed in one side of each of two sides of the chin skeleton in sequence from top to bottom; the plug opening communicates with the inside of the clamping opening, and a width of the clamping opening is less than that of the plug opening; and each T-shaped sliding clamping head is fastened to the clamping opening after passing through the plug opening.

As one preferable solution of the present disclosure, the top of each of two ends of the chin skeleton is fixedly connected with a one-piece structured sleeve head; the sleeve head is matched with each sleeve member in size and is plugged and fixed with the sleeve member; and a second plug hole is formed in a surface of the sleeve head.

As one preferable solution of the present disclosure, a sunken pin hole penetrating through the EPS inner layer and the EPS liner is formed in the inner side of the head guard; and the sunken pin hole is plugged and fixed with the second plug holes and the first plug holes through the plug pins.

As one preferable solution of the present disclosure, open slots with inclined "7"-shaped sections are formed in positions of the head guard directly facing the skeleton connection members, and fastening bulges matched with the open slots are arranged at positions of the chin guard directly facing the chin skeleton.

As one preferable solution of the present disclosure, the skeleton connection members and the chin skeleton are made of different materials.

Compared with the existing art, the present disclosure has the following beneficial effects.

1) The skeleton of the helmet body adopts the spliced type skeleton; in the production process of the skeleton, the skeleton connection members and the chin skeleton are subjected to split type machining, which can reduce the mold opening cost to a certain extent; especially compared to machining of a traditional complicated helmet skeleton, this machining mode can effectively increase the yield of skeleton machined finished products; meanwhile, due to the spliced skeleton subjected to the split type machining, a user can assemble and disassemble the head guard and the chin guard according to an actual use need during daily use of the helmet, so as to improve the practicability of the helmet.
2) The T-shaped sliding clamping heads of the spliced skeleton is clamped with the clamping openings; the sleeve heads and the sleeve heads are sleeved and are plugged through the plug pins, so that the spliced skeleton can be quickly spliced to be assembled and disassembled; furthermore, in the daily use process of the helmet, the chin guard can be quickly removed from the head guard by taking down the plug pin.
3) The chin skeleton and the skeleton connection members of the spliced skeleton are subjected to the split type machining, so that different materials can be selected to manufacture the chin skeleton and the skeleton connection members; and different materials can be adjusted according to a production need of the helmet, so that the customization degree is higher, and the flexible selectivity of the users is also improved.

Figure 1:
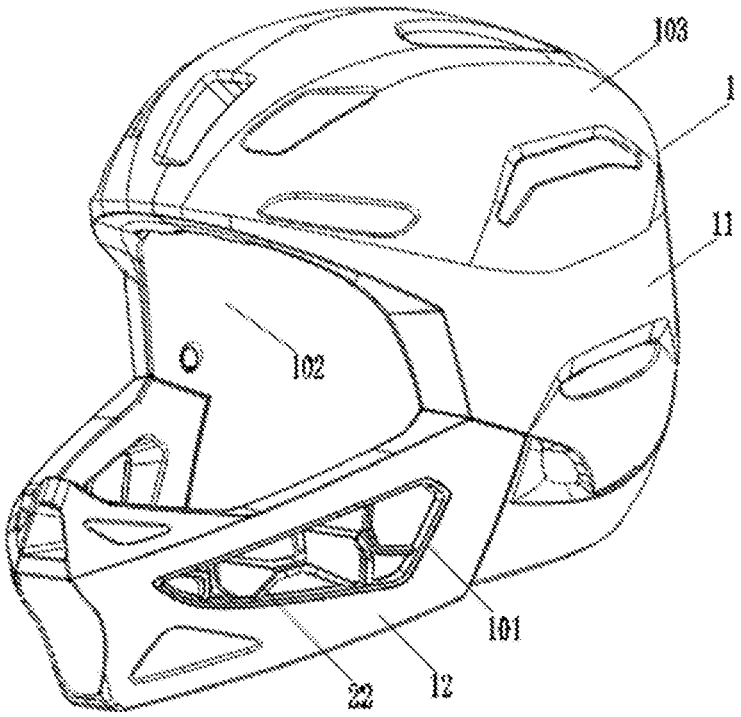
FIG. 1 is a schematic structural diagram of the present disclosure.

In the drawings: 1: helmet body; 101: EPS liner; 102: EPS inner layer; 103: PC surface layer; 11: head guard; 111: sunken pin hole; 112: open slot; 12: chin guard; 2: spliced skeleton; 21: skeleton connection member; 211: T-shaped sliding clamping head; 212: sleeve member; 213: first plug hole; 22: chin skeleton; 221: reinforcing rib; 222: plug opening; 223: clamping opening; 224: sleeve head; 2241: second plug hole; and 23: plug pin.

DETAILED DESCRIPTION OF THE EMBODIMENTS

The following clearly and completely describes the technical solution in the embodiments of the present invention in combination with the accompanying drawings of the embodiments of the present invention. Apparently, the described embodiments are only part of the embodiments of the present invention, not all embodiments. Based on the embodiments in the present disclosure, all other embodiments obtained by those of ordinary skill in the art without creative work shall fall within the protection scope of the present disclosure.

Figure 2:
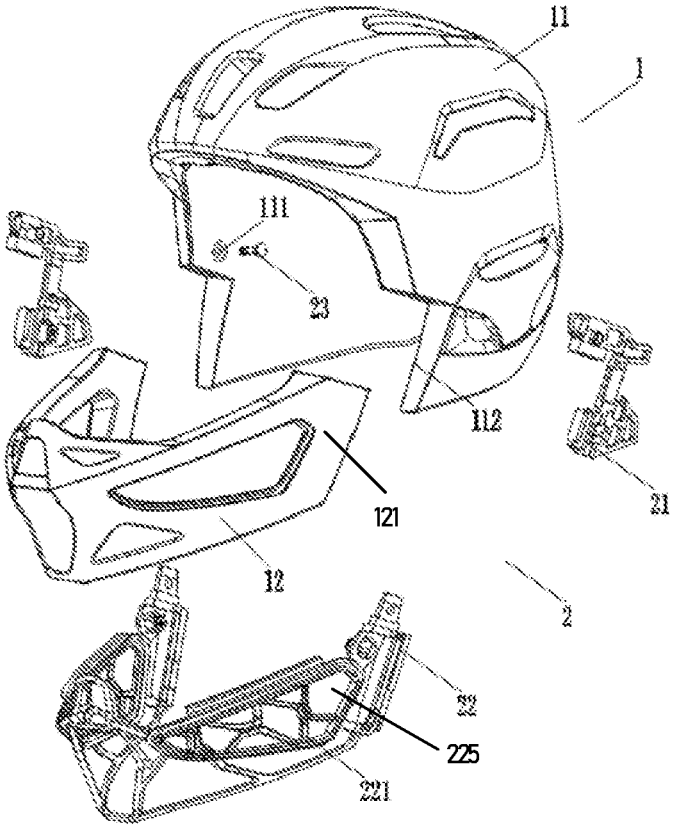
FIG. 2 is a schematic splitting diagram of the present disclosure.
Figure 3:
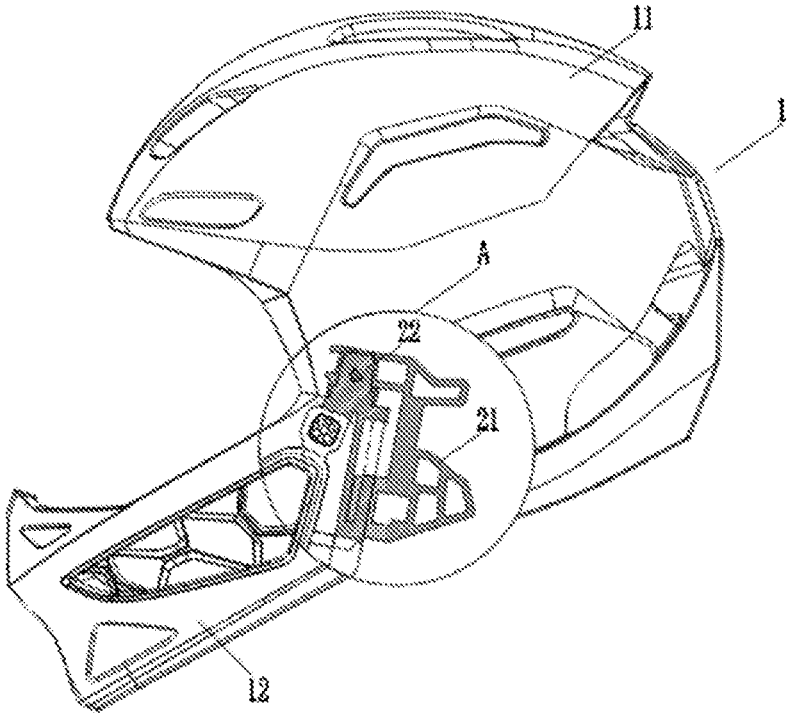
FIG. 3 is a schematic diagram of an internal structure of the present disclosure.
Figure 4:
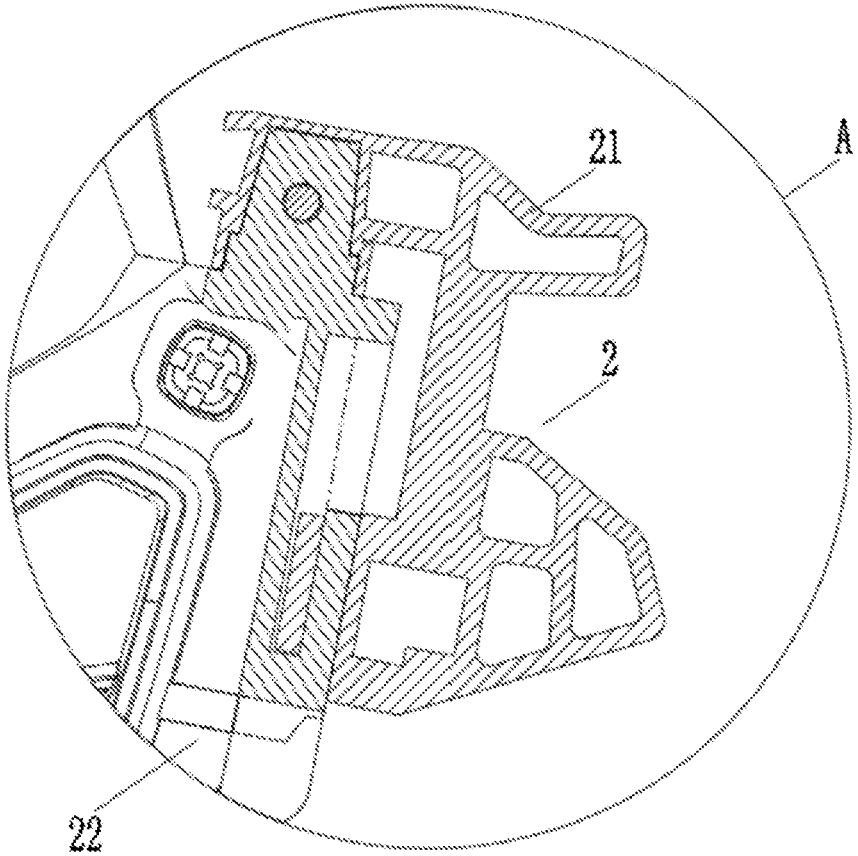
FIG. 4 is an enlarged schematic diagram of a portion A of FIG. 3 of the present disclosure.
Figure 5:
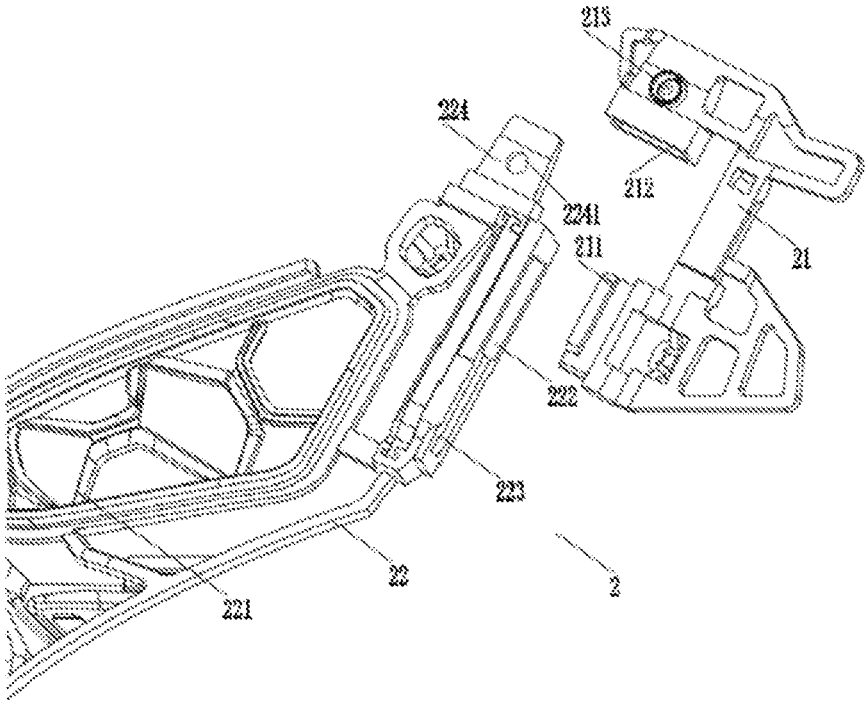
FIG. 5 is a schematic structural diagram of a spliced skeleton of the present disclosure.

Referring to FIGS. 1-5, the present disclosure provides one technical solution: a helmet with a split type skeleton structure, including a helmet body 1. The helmet body 1 is composed of a head guard 11 and a chin guard 12 which are separated, and the head guard 11 and the chin guard 12 are mounted through cooperation between a fastened spliced skeleton 2 and a plug pin 23. By means of the plug pin 23, the spliced skeleton 2 can be quickly spliced; and meanwhile, quick assembling and disassembling between the head guard 11 and the chin guard 12 are facilitated.

In particular, the spliced skeleton 2 is composed of two skeleton connection members 21 arranged inside the head guard 11 and a chin skeleton 22 arranged inside the chin guard 12. The spliced skeleton 2 is composed of the skeleton connection members 21 and the chin skeleton 22, so that when the spliced skeleton 2 is machined, the skeleton connection members 21 and the chin skeleton 22 are subjected to split machining, which reduces the mold opening cost during skeleton manufacturing. Hollows of a surface of the chin skeleton 22 is fixedly connected with a plurality of one-piece structured reinforcing ribs 221. The plurality of reinforcing ribs 221 may be machined in one piece during the machining of the skeleton connection members 21 and the chin skeleton 22. The plurality of reinforcing ribs 221 may be arranged in a honeycomb shape or a strip shape, so that the skeleton has higher structural strength while it has light weight.

In this embodiment, the helmet body 1 is of a three-layer structure; an expanded polystyrene (EPS) liner 101 is located at a middle layer; the EPS liner 101 is wrapped outside the skeleton connection members 21 and the chin skeleton 22; an inner side of the EPS liner 101 is adhered with an EPS inner layer 102; and an outer side of the EPS liner 101 is adhered with a polycarbonate (PC) surface layer 103.

Specifically, the helmet also adopts a three-layer structure. After the skeleton has been manufactured, the EPS liner 101 is injection-molded outside the skeleton connection members 21; the EPS liner 101 can wrap the skeleton and also facilitating subsequent machining of the EPS inner layer 102 and the PC surface layer 103, so that the helmet has relatively good buffer property and wear comfort; and the PC surface layer 103 located on the outermost layer also ensures that the helmet has relatively high structural strength and ensures the safety of the helmet.

In this embodiment, the bottom of one side of each skeleton connection member 21 is fixedly connected with a one-piece structured T-shaped sliding clamping head 211; the top of one side of each skeleton connection member 21 is fixedly connected with a one-piece structured sleeve member 212; a first plug hole 213 is formed in a surface of the sleeve member 212; a plug opening 222 and a clamping opening 223 are formed in one side of each of two ends of the chin skeleton 22 in sequence from top to bottom; the plug opening 222 communicates with the inside of the clamping opening 223, and a width of the clamping opening 223 is less than that of the plug opening 222; the T-shaped sliding clamping head 211 is fastened to the clamping opening 223 after passing through the plug opening 222; the top of each of two ends of the chin skeleton 22 is fixedly connected with a one-piece structured sleeve head 224; the sleeve head 224 is matched with the sleeve member 212 in size and is plugged and fixed with the sleeve member 212; a second plug hole 2241 is formed in a surface of the sleeve head 224; a sunken pin hole 111 penetrating through the EPS inner layer 102 and the EPS liner 101 is formed in the inner side of the head guard 11; and the sunken pin hole 111 is plugged and fixed with the second plug hole 2241 and the first plug hole 213 through the plug pin 23.

Specifically, when the head guard 11 and the chin guard 12 are assembled and disassembled, only the skeleton connection members 21 and the chin skeletons 22 are assembled and disassembled. When the skeleton connection members 21 and the chin skeleton 22 need to be mounted, the T-shaped sliding clamping heads 211 are firstly plugged into the plug openings 222, and the sleeve members 212 then directly face the sleeve heads 224; the chin skeleton 22 is then upwards pushed to enable the T-shaped sliding clamping heads 211 to be fastened in the clamping openings 223 for locking; at the same time, the sleeve heads 224 are completely plugged into the sleeve members 212; finally, one end of each plug pin 23 passes through the sunken pin hole 111 and is plugged and fixed with each second plug hole 2241 and each first plug hole 213, so as to realize locking of the skeleton connection members 21 and the chin skeleton 22, thus quickly completing the mounting of the head guard 11 and the chin guard 12; and during dismantling, the operations are performed reversely.

In this embodiment, open slots 112 with inclined "7"-shaped sections are formed in positions of the head guard 11 directly facing the skeleton connection members 21, and fastening bulges matched with the open slots 112 are arranged at positions of the chin guard 12 directly facing the chin skeleton 22.

Specifically, when the head guard 11 and the chin guard 12 are assembled, the open slots 112 and the fastening bulges are fastened with each other; and under the plugged locking action of the plug pins 23, the chin guard 12 is prevented from falling off from the head guard 11.

In this embodiment, the skeleton connection members 21 and the chin skeleton 22 are made of different materials.

Specifically, the skeleton connection members 21 and the chin skeleton 22 of different materials may be adjusted according to a production need of the helmet, so that the customization degree is higher, and the flexible selectivity of users is also improved.

The contents not described in detail in this specification belong to the prior art known to the professional and technical personnel in the art. Although the present disclosure has been described in detail with reference to the foregoing embodiments, those skilled in the art still can modify the technical solutions disclosed in the foregoing various embodiments, or make equivalent replacement to partial technical features. Any modifications, equivalent replacements, improvements and the like that are made without departing from the spirit and principle of the present disclosure shall all fall within the protection scope of the present disclosure.

What is claimed is:

1. A helmet with a split type skeleton structure, comprising a helmet body (1), wherein the helmet body (1) is composed of a head guard (11) and a chin guard (12) which are separated, and the head guard (11) and the chin guard (12) are mounted through cooperation between a fastened spliced skeleton (2) and a plug pin (23);

the spliced skeleton (2) is composed of two skeleton connection members (21) arranged inside the head guard (11) and a chin skeleton (22) arranged inside the chin guard (12); the chin skeleton (22) defines at least one hollow portion and a plurality of one-piece structured reinforcing ribs (221) are fixedly connected in the at least one hollow portion;

the helmet body (1) is of a three-layer structure; an expanded polystyrene (EPS) liner (101) is located at a middle layer, the EPS liner (101) is wrapped outside the skeleton connection members (21) and the chin skeleton (22); an inner side of the EPS liner (101) is adhered with an EPS inner layer (102); and an outer side of the EPS liner (101) is adhered with a polycarbonate (PC) surface layer (103), wherein the bottom of one side of each skeleton connection member (21) is fixedly connected with a one-piece structured T-shaped sliding clamping head (211): the top of one side of each skeleton connection member (21) is fixedly connected with a one-piece structured sleeve member (212); and a first plug hole (213) is formed in a surface of the sleeve member (212).

2. The helmet with the split type skeleton structure according to claim 1, wherein a plug opening (222) and a clamping opening (223) are formed in one side of each of two sides of the chin skeleton (22) in sequence from top to bottom; the plug opening (222) communicates with the inside of the clamping opening (223), and a width of the clamping opening (223) is less than that of the plug opening (222); and each T-shaped sliding clamping head (211) is fastened to the clamping opening (223) after passing through the plug opening (222).

3. The helmet with the split type skeleton structure according to claim 2, wherein the top of each of two ends of the chin skeleton (22) is fixedly connected with a one-piece structured sleeve head (224); the sleeve head (224) is matched with each sleeve member (212) in size and is plugged and fixed with the sleeve member (212); and a second plug hole (2241) is formed in a surface of the sleeve head (224).

4. The helmet with the split type skeleton structure according to claim 3, wherein a sunken pin hole (111) penetrating through the EPS inner layer (102) and the EPS liner (101) is formed in the inner side of the head guard (11); and the sunken pin hole (111) is plugged and fixed with the second plug holes (2241) and the first plug holes (213) through plug pins (23).

5. The helmet with the split type skeleton structure according to claim 1, wherein open slots (112) with inclined "7"-shaped sections are formed in positions of the head guard (11) directly facing the skeleton connection members (21), and fastening bulges matched with the open slots (112) are arranged at positions of the chin guard (12) directly facing the chin skeleton (22).

6. The helmet with the split type skeleton structure according to claim 1, wherein the skeleton connection members (21) and the chin skeleton (22) are made of different materials.

* * * * *